US009144819B1

(12) United States Patent
Winter

(10) Patent No.: US 9,144,819 B1
(45) Date of Patent: Sep. 29, 2015

(54) APPARATUS, METHOD, AND SYSTEM FOR APPLYING LIQUID COATING TO ELONGATED MEMBERS INCLUDING ARROW SHAFTS

(76) Inventor: Francis G. Winter, Waterloo, IA (US)

( * ) Notice: Subject to any disclaimer, the term of this patent is extended or adjusted under 35 U.S.C. 154(b) by 1427 days.

(21) Appl. No.: 13/004,644

(22) Filed: Jan. 11, 2011

Related U.S. Application Data

(60) Provisional application No. 61/294,353, filed on Jan. 12, 2010.

(51) Int. Cl.

| | |
|---|---|
| ***B05C 11/00*** | (2006.01) |
| ***B05C 11/02*** | (2006.01) |
| ***B05C 17/10*** | (2006.01) |
| *B44D 3/12* | (2006.01) |

(52) U.S. Cl.
CPC ..... *B05C 11/02* (2013.01); *B05C 11/021* (2013.01); *B44D 3/128* (2013.01)

(58) Field of Classification Search
None
See application file for complete search history.

(56) References Cited

U.S. PATENT DOCUMENTS

| | | | | |
|---|---|---|---|---|
| 2,257,432 | A * | 9/1941 | Smith | 118/102 |
| 2,921,330 | A * | 1/1960 | Prytikin | 401/122 |
| 4,091,489 | A * | 5/1978 | Nimetz | 118/268 |
| 5,520,737 | A * | 5/1996 | Denton | 118/429 |
| 5,820,676 | A * | 10/1998 | Bauerle | 118/421 |
| 8,079,768 | B1 * | 12/2011 | McLaughlin | 401/122 |
| 2009/0092436 | A1 * | 4/2009 | Mercier | 401/122 |

* cited by examiner

*Primary Examiner* — Dah-Wei D Yuan
*Assistant Examiner* — Binu Thomas
(74) *Attorney, Agent, or Firm* — McKee, Voorhees & Sease, PLC

(57) ABSTRACT

An apparatus, method and system for applying a liquid coating on an elongated work piece. One example is an arrow shaft. The apparatus comprises a body with a wiper on or in the body. A mounting interface allows the body to be mounted on a support, which in one example is the top of a can holding the liquid to be applied. An excess amount of liquid is applied to the work piece (e.g. by dipping an end or other application of the liquid to a location along the work piece, and the work piece is then moved past the wiper such that the wiper wipes the liquid on the work piece but gathers excess liquid for substantially even coating of the liquid along the work piece.

11 Claims, 6 Drawing Sheets

(PERSPECTIVE)

(RIGHT SIDE)

(FRONT)

(TOP)

(LEFT SIDE)

(BOTTOM)

DIMENSIONS IN INCHES
UNLESS OTHERWISE NOTED:
TOLERANCE ±0.020
3° DRAFT
R0.125"

(BACK)

APPARATUS, METHOD, AND SYSTEM FOR APPLYING LIQUID COATING TO ELONGATED MEMBERS INCLUDING ARROW SHAFTS

CROSS-REFERENCE TO RELATED APPLICATIONS

This application claims priority under 35 U.S.C. §119 to provisional application Ser. No. 61/294,353 filed Jan. 12, 2010, herein incorporated by reference in its entirety.

BACKGROUND OF THE INVENTION

A. Field of the Invention

The present invention relates to an apparatus, method, and system for applying liquid coatings to elongated members such as arrow shafts and analogous pieces.

B. Problems in the Art

A variety of situations exist where it is desirable to apply a coating of liquid to an elongated object. A typical method of application is to use a brush, sponge, or cloth as an applicator. The applicator is dipped into the container of liquid. The worker holds the work piece (elongated member) in one hand and applies the liquid from the applicator along the work piece.

This presents well-known issues. One is uniform or consistent application of the liquid. Such is very dependent on the care or skill of the worker, and the effectiveness of the applicator. Results can easily be inconsistent or poor. Some application techniques use much more liquid than required and thus is wasteful. Some techniques over-apply to try to ensure full coverage. But over-application can not only waste liquid but could detrimentally affect operation of the work piece. Some techniques do not economically or efficiently transfer the liquid from the applicator to the member. For example, not all of the liquid on a brush or cloth is transferred to the member being coated. It is hard to use all the liquid from the applicator. It is also hard to recover unused liquid from the applicator.

Another issue is over-spill and clean-up. Typically, relevant liquids are packaged and stored in cans with removable lids. If brushes, sponges, or cloths are used as applicators, excess liquid on the applicator can be wiped off along the can top lip. But some can spill or drip down the side and/or some can be caught in the groove or channel around the top lip of the can. There can also be drips, over-spill, and splatters when applying liquid to the work piece. This also leads to the issue of clean-up. It takes time to clean-up. There are also disposal issues. Brushes, sponges and cloth either need to be washed out or cleaned up, if even possible, or disposed of.

Sometimes the work piece is mounted in some sort of holder like a clamp, work bench vice, or the like. This too presents issues because the part of the work piece being held in the clamp or vice cannot be coated. This could take extra steps.

These types of issues can be further appreciated with reference to a specific type of work piece. Some people like to construct their own arrows for hunting or target purposes. They must provide an elongated arrow shaft and then either create or add a tip or point on one end and the nock on the other, and then later add the fletching or vanes towards the nock end of the shaft. While some shafts are left without any finishing on the outer surface, many arrow makers want to finish them with some sort of coating. Examples would be protective coating, a stain, a lacquer, or paint. This might be desirable along the entire shaft or only a portion thereof. For example, some would want a color over just a section of the length of the shaft. This is sometimes called capping or cresting.

Attempts have been made to improve arrow shaft coating. One example is a dip tube, an elongated tube that must be filled with the liquid. A rubber gasket or grommet with a center opening about the same diameter as the arrow shaft is clamped across the top of the dip tube. The arrow shaft is inserted through the gasket and down into the liquid in the tube the length to be coated. For a whole shaft, the tube must be on the same order of length as the shaft. The shaft is then removed from the tube. The gasket stops excess liquid from moving past the gasket and leaves a coating of liquid on the shaft. The process can be repeated for as many coats of the liquid as desired. Some of the liquids used dry quite quickly (e.g. 15 seconds), so several coats (e.g. three is a typical number) can be finished in several minutes. Several examples of dip tubes and gaskets can be commercially purchased and are available from 3Rivers Archery Supply, Inc., Ashley, Ind. USA (see information regarding the same at: www.3RiversArchery.com/Arrow+Building+Tools+Dip+Tubes_c52_s8_p29_thumb.html).

However, dip tubes require the dip tube to be filled prior to coating. For a full shaft dip tube this can mean sometimes 1 and ½ pints must be poured from the can(s). The can(s) is/are then typically resealed (e.g. lid secured back on the can). Then the worker must return to the dip tube and the gasket must be clamped in. Then the arrow must be guided through the gasket down into the tube, and then withdrawn. Once done, the can lid must be removed again, the excess liquid in the dip tube must be poured back into the can(s) and the items cleaned up for storage. This can be time-consuming and somewhat cumbersome. It can also be wasteful of the liquid.

It would be beneficial and an improvement to provide a way to improve the efficiency, economy, and other aspects of coating arrow shafts. It would be beneficial to deter over-application, spillage, loss of liquid, and uneven application. These issues apply whether one arrow shaft is coated or a batch of them are coated. The issues apply to other work pieces.

Room for improvement in coating elongated work pieces has therefore been identified.

SUMMARY OF THE INVENTION

A. Objects, Features, Aspects, or Advantages of the Invention

Therefore, the present invention has as a primary object, feature, aspect, or advantage to solve or improve over problems and deficiencies in the art. Other objects, features, aspects or advantages of the invention include one or more of the following:

a) An improvement over the state of the art.
b) Provides assistance in efficient, consistent and repeatable application of a liquid coating to an elongated work piece.
c) Addresses economical and efficient use of the liquid.
d) Addresses clean-up issues.
e) Addresses efficient use of time to coat the work piece or pieces.
f) Allows basically a single step application.

These and other objects, features, aspects, or advantages of the present invention will become apparent with reference to the accompanying specification and claims.

B. Summary of Aspects

In one aspect of the invention, the method comprises providing mounting a diaphragm, gasket, or grommet of the type used with dip tubes directly at or near the opened mouth of a can of liquid to be coated (what will be sometimes alternatively called generically herein a wiper or wiper piece or wiper member), applying a quantity of liquid to be coated from the can onto the elongated work piece, and then moving the work piece past the gasket. The gasket coats liquid on the work piece. The original amount of applied quantity of liquid is on the interior side of the gasket relative the interior of the can so that excess liquid is stopped by the gasket and can move by gravity down towards the interior of the can, or can be assisted by wiping or otherwise directing it back into the can. The gasket is thus moved to the can, instead of emptying the can into a dip tube. In one example one end of the elongated work piece is dipped in the liquid in the can and then directly inserted into the center opening in the gasket on the interior side of gasket. The entire length of the work piece is then pushed through the gasket. One through it is retrieved on the exterior side of the gasket and the full piece is coated. In another example, the work piece is inserted partially through the gasket. Liquid is brushed or otherwise placed on a portion of the work piece over the mouth of the can. The work piece is then again pushed out through the gasket to coat just a part of the work piece. The method is efficient of time and liquid. The lid of the can is removed. The tool with gasket is mounted to the can mouth. The work piece, with a quantity of liquid applied directly from the can, is passed through the gasket. This minimizes steps. It does not require transfer of liquid from container to container. It collects excess liquid right above the can mouth.

An apparatus according to an aspect of the invention comprises a can-mountable tool with a diaphragm, gasket, or wiper piece for coating elongated work pieces with liquid from the can. The body of the tool includes a holder for a diaphragm, gasket, or wiper piece of the general type used with dipper tubes. The wiper piece is adapted to wipe liquid on the work piece as the work piece is moved past the wiper. The wiper promotes even and efficient distribution of the liquid along the work piece. The wiper can be configured to have a wiping edge that surrounds the work piece. The wiper piece can be removably mounted to the body. It then, therefore, could be changed out and washed or thrown away after each use. The body can include a mounting interface to mount the body on a support. In one aspect, the support can be the container of the liquid which is being coated on the work piece. In one example, the mounting interface is a clamp that can clamp the body onto the top sealing lip of a typical lidded container by using a threaded screw or bolt to clamp the body in place. This allows the apparatus to be mounted on the container of the liquid to be coated, which allows effective and efficient dipping of the work piece or otherwise applying a quantity of the liquid to the work piece, and immediate moving of the work piece by the wiper to coat the work piece. Waste is reduced by wiping the liquid along the work piece to produce an even coating. Excess can be caught by the wiper. In some cases, excess can be directed automatically back into the liquid container.

In another aspect of the invention, a system for applying liquid coatings to elongated work pieces comprises a body with a wiper or diaphragm piece mounted on or to it, a mounting interface on the body to mount the body to the lip of a container of the liquid to be applied, and one or more work pieces. The system involves dipping a portion of a work piece in the liquid in the container and then moving that portion to the wiper. The work piece is then moved a desired amount further past the wiper to wipe at least a portion of the original starting amount of liquid. The desired amount can be the entire remainder of the work piece or just a fraction thereof. The process can be repeated for other work pieces. The wiper and body can be cleanable and reuseable, or single- or limited-use and then disposable. The body can be removably mountable to the container. After the desired number of work pieces are coated with liquid from a container, the body can be removed from the container, the container can be resealed, and the body and container stored for a next use.

In another aspect of the invention, the elongated work piece is an arrow shaft that utilizes one or more of the apparatus, method, or system described above. The liquid can be any of a variety of liquids, including but not limited to, paint, varnish, lacquer, protective coating, sealer, or stain.

In another aspect of the invention, the work piece can be any elongated member whether of circular or other cross-section. The wiper member has a wiping edge that conforms to the perimeter shape of the work piece. The wiping member comprises a material having an aperture that at least substantially matches the cross-sectional shape of the work piece; the aperture being approximately the same diameter or shape as the cross-section of the work piece, or slightly smaller such that it wipes or guides a limited amount of liquid along the work piece in an effective coating. The wiping edge can be flexible.

DETAILED DESCRIPTION OF EXEMPLARY EMBODIMENT

A. Overview

For a better understanding of the invention, one example of a form the invention can take will now be described in detail. This is but one form the invention can take. It is neither inclusive nor exclusive of all forms.

The exemplary embodiment will be described in the context of an apparatus that can be mounted removably to the upper sealing lip or rim of a conventional metal paint- or varnish-type can. It is to be appreciated, however, that other mounting interfaces for other containers or other supports are possible.

The exemplary embodiment will be discussed in the context of coating an arrow shaft such as is used for bow hunting. As can be appreciated, however, the invention can be utilized for other elongated work pieces. For example, dowel rods can be painted or varnished for furniture, hobby projects, or other uses. Small metal or plastic tubes can likewise be coated. The work piece does not have to be circular in cross-section. The work piece does not have to be of consistent shape along its length (e.g. some arrow shafts are tapered; some elongated pieces do not have identical external cross-sectional dimensions all along their length). In other words, the elongated, dowel-like end of a work piece that has another end of much larger size could be coated with the present invention. The invention could be used to apply a liquid on just the portion of an elongated work piece by control of how much of the work piece is moved past the wiper.

B. Apparatus

Figure 1:
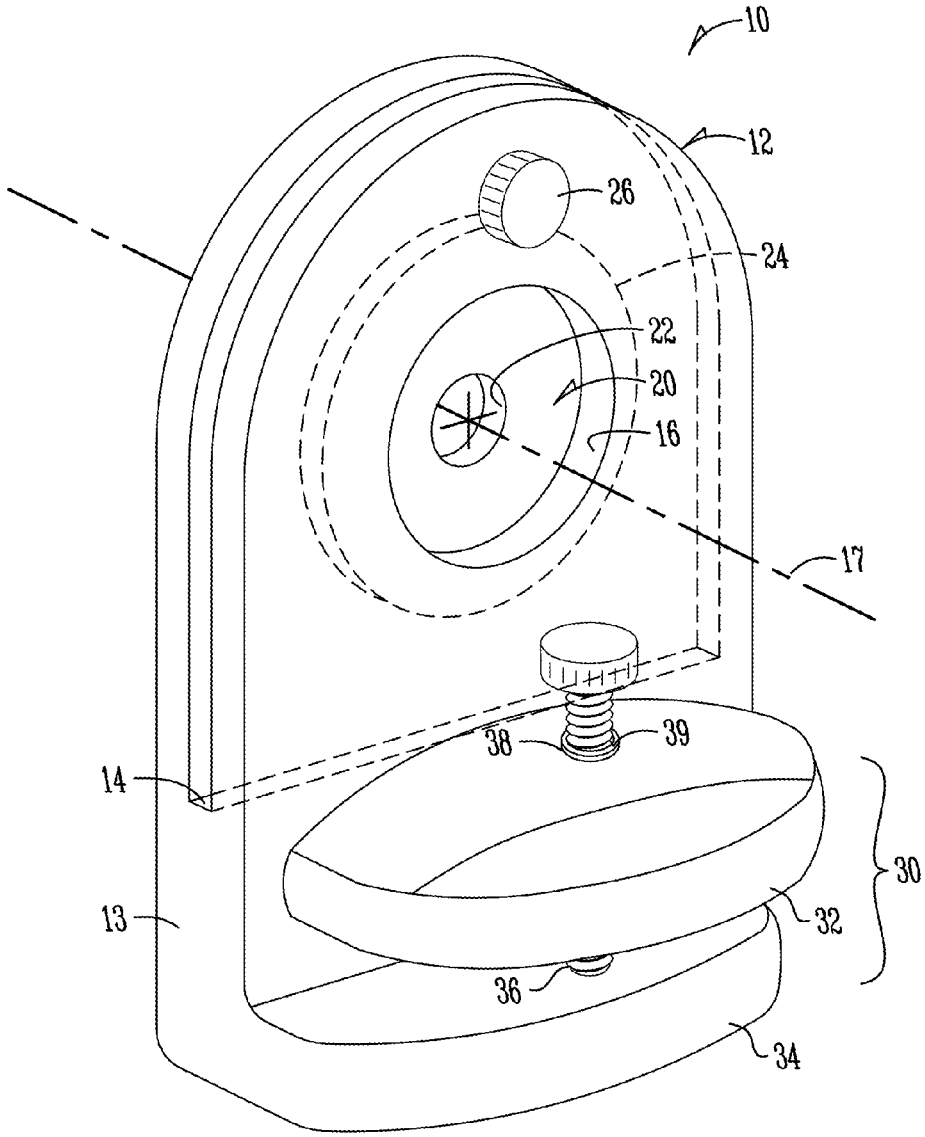
FIG. 1 is a perspective assembled view of one exemplary embodiment according to the present invention referred to generally as tool 10.
Figure 2A:
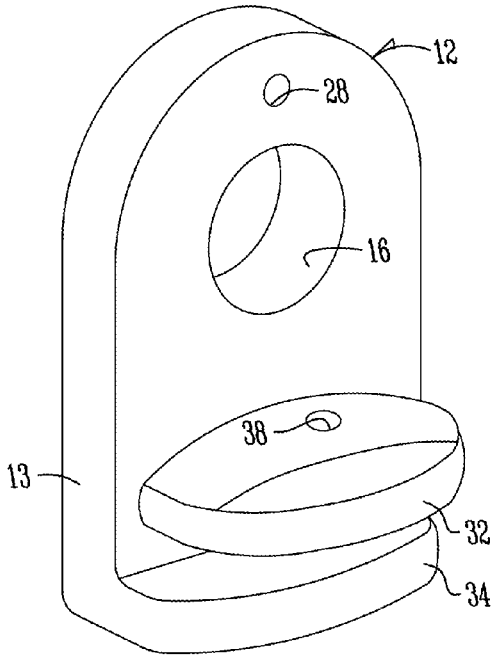
FIGS. 2A-G are isometric views of a starting form for the body of tool 10 of FIG. 1 after being molded or cast form.
Figure 2B:
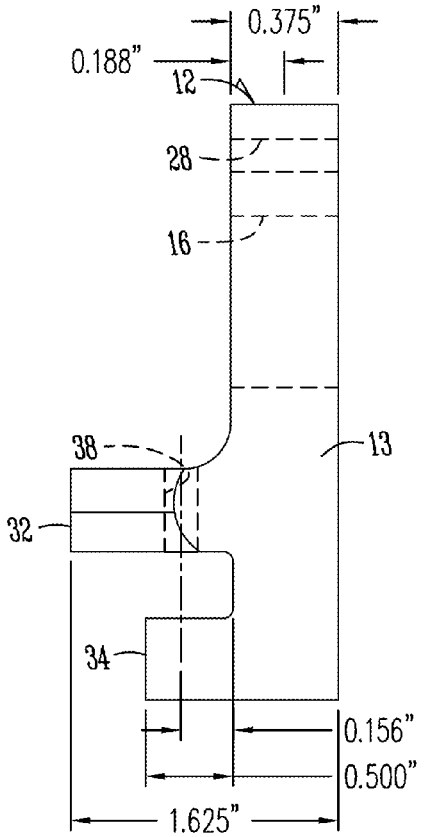
Figure 2C:
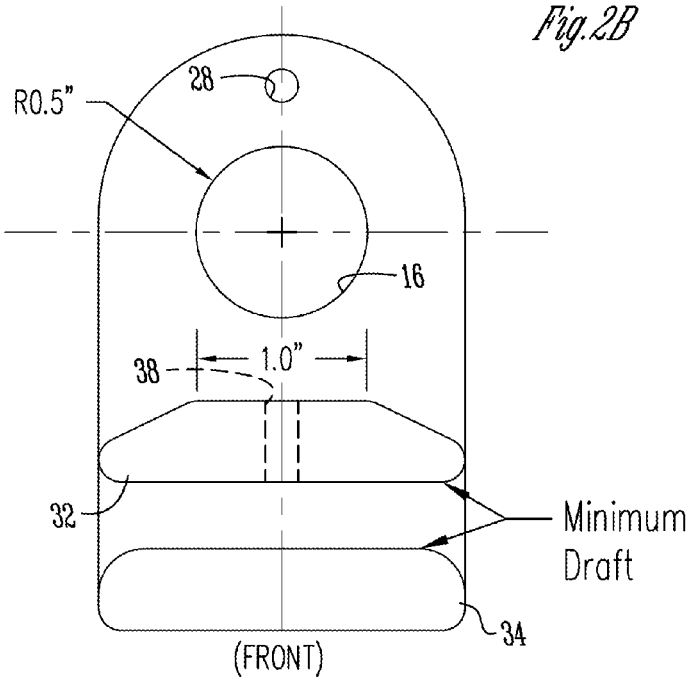
Figure 2D:
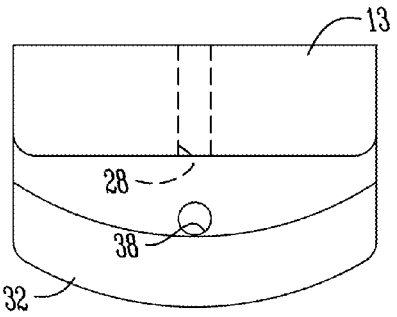
Figure 2E:
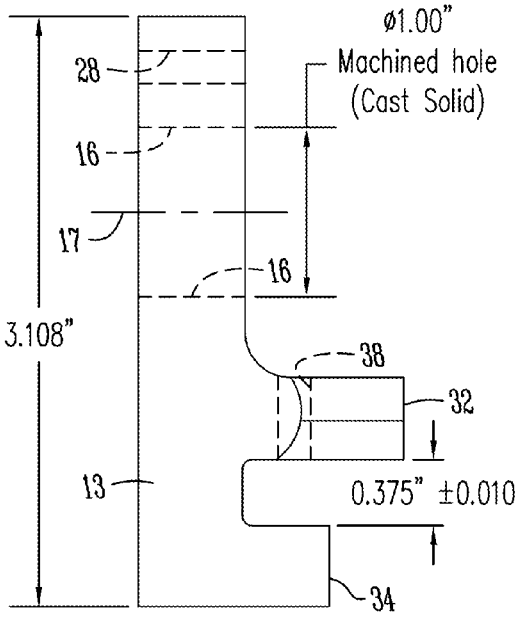
Figure 2F:
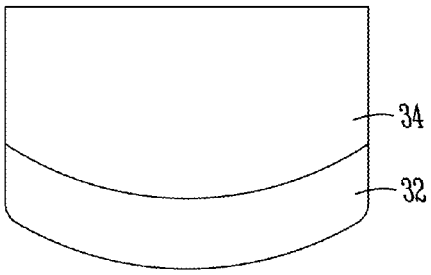
Figure 2G:
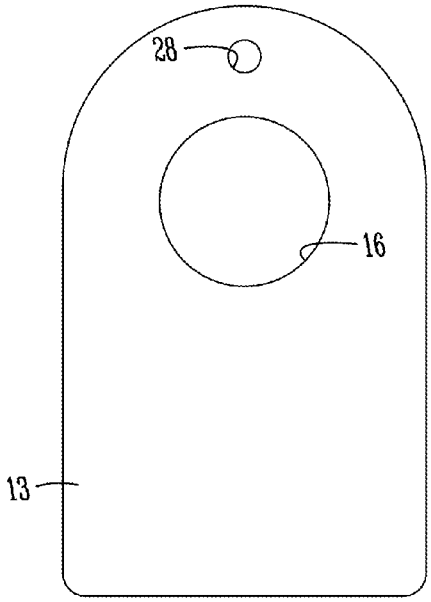
Figure 3:
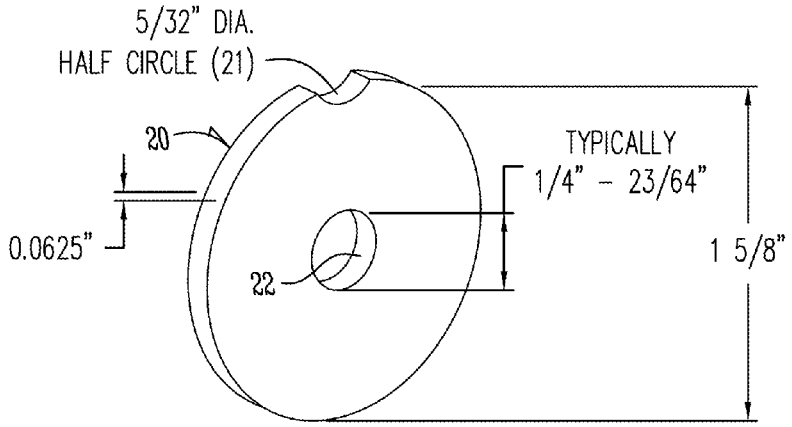
FIG. 3 is a perspective view of the wiper piece isolated and removed from the embodiment of FIG. 1.
Figure 4:
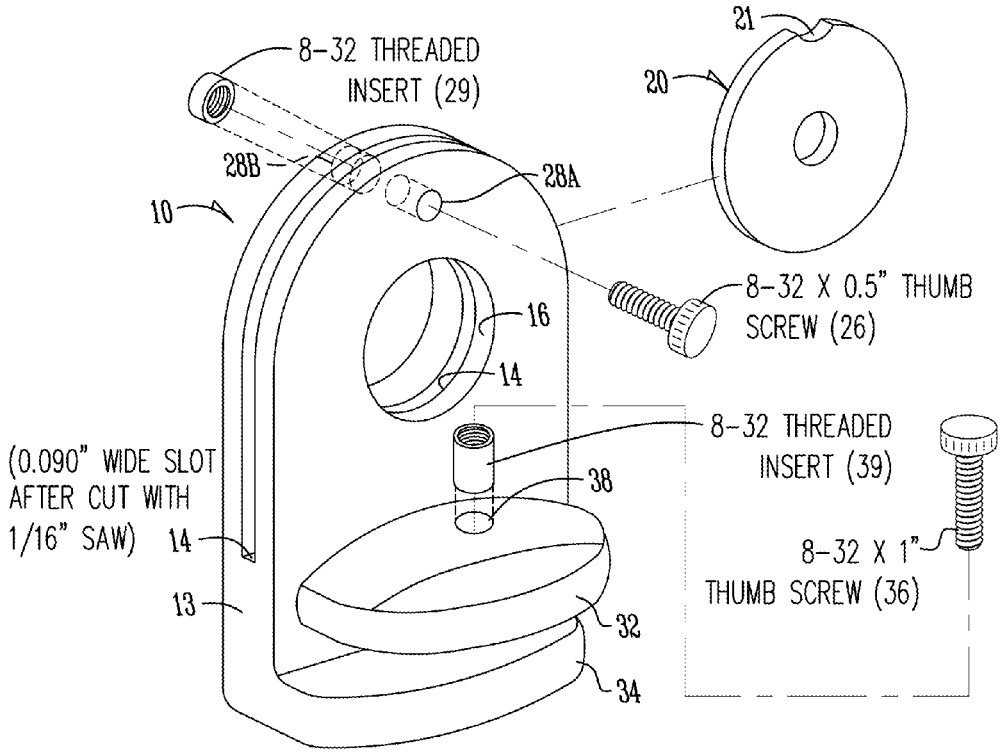
FIG. 4 is an exploded view of the pieces of tool 10 of FIG. 1.

FIGS. 1, 2A-G, 3, 4, and 5A-B show aspects of the exemplary apparatus, referred to herein generally as tool 10. Tool 10 has a plastic cast or molded body 12 of the general size and dimensions indicated in the Figures. In this embodiment, tool 10 is basically palm-sized and adapted to fit well onto a conventional quart sized metal cylindrical liquid container (although it can likewise by fit on other sizes—including but not limited to gallon or pint sizes). The assembled and exploded views of FIGS. 1 and 4 illustrate the components of tool 10.

1. Body 12

Body 12 has a main portion 13 and a mounting interface or clamping portion 30. In this example, body 12 is manufactured as follows. It is first solid cast or molded in the form shown in FIGS. 2A-G from a relatively inexpensive rigid plastic material (e.g. toxic-free urethane) for economy and durability; as well as ease of clean-up. In one example, the urethane can be of the following formulation: toxic-free silicone-based urethane. It has been found that this formulation resists sticking or strong adhesion of many of the liquids applied to arrow shafts. Thus, even if such liquid drips or spills onto body 12, it is more easily cleanable. It is to be understood, however, that body 12 could be formed from many alternative materials. Other plastics or polymers are possible. Just a few examples are nylon, Plexiglas™, acrylic, and Lucite™. But non-plastics are also possible. Examples include wood, composite, fiberglass, and metal.

Note in FIGS. 2A-G that several through-holes can be originally molded into body 12 (see through-holes 16, 28, 38) to reduce the amount of finishing needed for body 12. As can be appreciated, however, these features could be created after molding (e.g. by drilling, milling, or otherwise). Also, note that body 12 is molded to have substantially smooth and rounded surfaces and edges which are conducive to manually handling. Molding or casting can produce them; again avoiding time-consuming and costly post-molding finishing steps.

Main part 13 of body 12 has a width and length substantially larger than its thickness. The main circular aperture 16 (e.g. 0.75 to 1.25 inches in diameter) provides a passageway entirely through the thickness of part 13 along an axis 17 (see FIG. 1).

After initial molding or casting, to complete body 12 for assembly into tool 10, the following steps are taken.

A slot 14 is machined (e.g. sawed, milled, or otherwise formed) from the top of main part 13 of body 12 to down below opening 16 (see, e.g., FIG. 1).

Figure 5A:
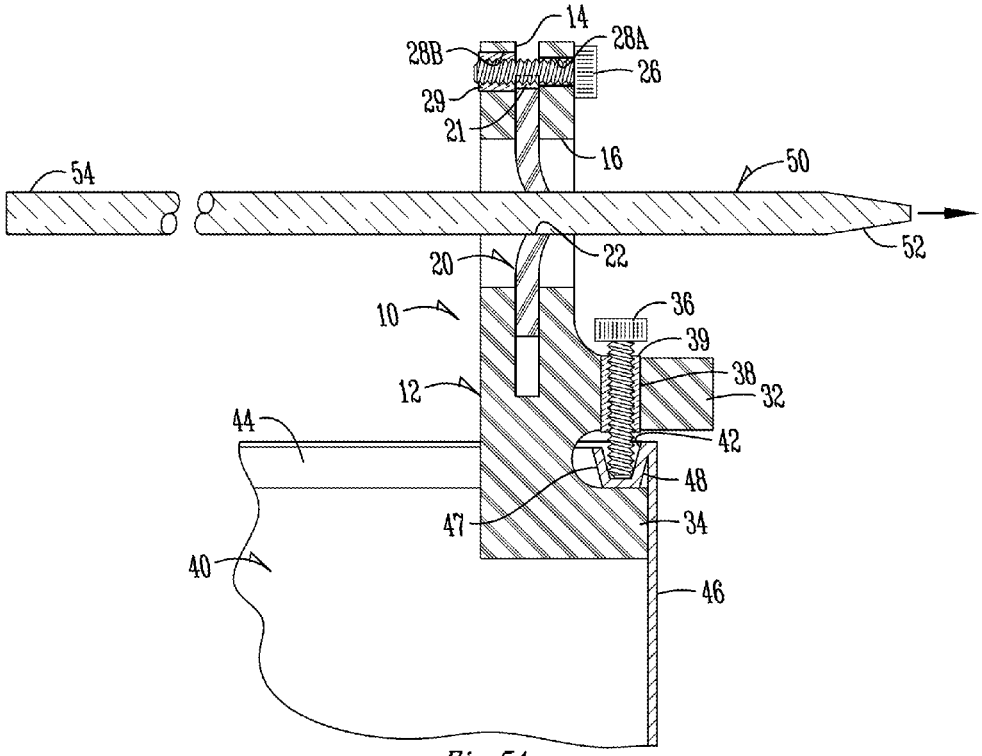
FIG. 5A is a sectional view of tool 10 of FIG. 1 mounted on the upper sealing lip of a can 40, taken along line 5A-5A of FIG. 5B.

As shown in FIGS. 2A and 5A, a smaller hole 28 extends from one face of main part 13 inwardly in communication with slot 14 and continues through the remainder of part 13 (the part of hole 28 forward of slot 14 is referred to as hole 28A; the part to the rear of slot 14 as hole 28B). A threaded insert 29 is interference-fit or otherwise mounted in hole 28B (see FIGS. 4 and 5A).

Similarly, a smaller hole 38 extends through upper lateral flange 32 of body 12. A threaded insert 39 is interference-fit or otherwise mounted in hole 38 (see FIGS. 4 and 5A).

2. Wiper Piece 20

FIG. 3 shows in isolation what will be called gasket, grommet, disc, diaphragm, wiper piece, or wiper 20. It is removably insertable into slot 14 of body 12. It is the part of the assembled tool 12 that wipes the liquid to be coated on the exterior of the work piece to be coated.

In this example, gasket 20 is an Eco-Dipper™ gasket, Item 6199-1 commercially available at www.3RiversArchery.com. Wiper 20 can otherwise be similar to gaskets such as sold with some dipper tube arrow shaft coating systems commercially available from a variety of sources (e.g. 3 Rivers Archery Supply Co.).

Diaphragm or wiper piece 20 a relatively thin (0.0625 inch thick), flexible, circular (1⅝ inch diameter) disc. In this example, it is a tan, 40+/−5 durometer, pure gum rubber material. It has been found to work well to wipe or apply the types of fluids used to coating arrow shafts. Additionally, it provides a subtle but important feature that assists in clean-up. Many of the relevant liquids might harden or dry (or begin to) and adhere to either side of disc 20. However, the flexible and other characteristics of disc 20 allow quick and easy removal of the dried or semi-dried liquid as follows. Flexing of disc 20 separates, breaks, or otherwise disrupts the liquid such that it tends to flake or be ejected from disc 20 by manually bending or flexing disc 20.

Orifice or opening 22 is preconfigured to have a diameter that is on the same order of as the shape and outside diameter of the work piece. For example, typical arrow shafts 50 have a diameter in the range of ¼ to 23⁄64 inch. Thus, orifice 22 is formed (typically in the center) in disc 20 (e.g. by original molding or by post molding finishing) of a diameter that is at least close to the diameter of the arrow(s) to be coated. Thus, opening 22 can be in the range of ¼ to 23⁄64 inch. In one example it is selected to be in the middle of that range so that it can perform for many shaft diameters in that range. On the other hand, opening 22 can be formed to be essentially the same diameter as the diameter of the arrow shaft (or even slightly smaller diameter) so that the entire perimeter of opening 22 close to or does abut the entire circumference of the shaft of arrow 50. The edge of opening 22 is therefore essentially a flexible 360° wiper edge. The material of wiper piece 20 has some flexibility and resilience (it is be elastomeric) similar to a windshield wiper on an automobile. As indicated in FIG. 5A, if opening 22 is smaller than the diameter of arrow shaft 50, the material of disc 20 around opening 22 will deform in a truncated cone shape in the direction of movement of shaft 50. This essentially conforms the entire 360° of the edge defining opening 22 around shaft 50 to wipe or brush liquid along shaft 50.

It is to be understood, however, that even if opening 22 is larger in diameter than shaft 50, it can still provide coating function. For example, some liquids (e.g. gasket lacquer) are relatively thick and high viscosity. Thus, even an opening 22 larger than shaft diameter (but just slightly larger) would guide the liquid in a relatively consistent layer along shaft 50 if shaft 50 is moved through opening 22. Thus, it is not necessary that opening 22 exactly match shaft diameter (or be slightly smaller).

The material of disc 20 is durable enough to experience the forces of even frictional engagement of an arrow shaft along its entire length or portion thereof while maintaining wiping contact with 360° of the arrow shaft circumference. A feature of the particular disc 20 of tool 10 is that it can withstand such forces, and many times for several arrows, but if needed disc 20 can be easily and relatively economically replaced if it cracks, deforms, or otherwise can not function as needed.

Note that wiper member 20 can be made of any of a variety of materials. The material described herein is but one example. As will be appreciated by those skilled in the art, other materials can be utilized and work, even if not as well as the material described herein.

Slot 14 of tool 10 is $1/16^{th}$ inch wide. As shown in FIG. 3, the width (e.g. 0.0625 inch) and perimeter 24 diameter (e.g. 1⅝ inches) of disc 20 can be preconfigured to slide into and out of slot 14. The outer perimeter dimensions of wiper piece 20 can approximate or be slightly less than the width and height of slot 14 so that disc 20 is substantially totally enclosed by slot 14 when centered on axis 17. Because both sides of the middle of disc 20 are exposed at opening 16 of body, the user can manually manipulate disc 20 to center it along axis 17 even though the perimeter 24 edges of disc 20 are substantially inside slot 14.

3. Wiper Piece Clamp 13 and 26

As indicated at FIGS. 1, 3, 4, and 5A and B, wiper piece 20 can be fixed in slot 14 of body 12 by a clamping action facilitated by the material of body 12 and thumbscrew 26, opening 28 and threaded insert 29 as follows.

Thumb screw 26 is removed from threaded insert 29 and withdrawn forwardly so that it has no part in slot 14. Disc 20 is slid into slot 14 to the position at least similar to FIG. 1. Thumb screw is then pushed through opening portion 28A and slot 14 and into threaded insert 29. Threaded insert 29 is fixed in place in opening portion 28B. Thumb screw is further tightened into insert 29 until its head or shoulder on its head end abuts the front side of main body portion 13. By further turning, thumb screw would draw the parts of main body portion 13 on opposite sides of slot 14 towards one another. This would serve to produce clamping action on disc 20 to fix it in place. To remove or adjust disc 20, thumb screw 26 is loosened. The material of body 12 has some flex and resiliency and can withstand many clamping actions and return to the original position without failure or breaking.

An optional feature to help position disc 20 in body 12 is shown in FIGS. 3 and 5A. Disc 20 can be formed to include a semi-circular cut-out 21 at its perimeter. The radius of cut-out 21 can approximate the radius of the threaded shaft of thumb screw 26. The diameter of disc 21 and the distance between opening 28 and axis 17 can be designed such that when disc 20 is slid into slot 14 and thumb screw 26 moved through slot 14, disc 20 can be moved up to abutment with the shaft of thumb screw 26 and rotated until cut-out 21 aligns with the thumb screw shaft. This can be felt by the person rotating disc 20 as cut-out 21 is an indexing mechanism that can be tactilely perceived. The person can then know disc 20 is in approximately the proper position and can turn thumbscrew 26 into insert 29 and clamp disc 20 in place.

4. Can Mounting Clamp 30 and 36

FIGS. 1, 2A-G, 5A-B illustrate in more detail what will be called the mounting interface or can clamp 30 for tool 10. Can mounting interface essentially uses two generally parallel, spaced apart, laterally extending flanges 32 and 34 from main body portion 13 and a thumbscrew 36 and complementary threaded insert 39 to clamp body 12 onto the rim or lip 44 of a typical can of liquid relevant to coating arrow shafts.

Figure 5B:
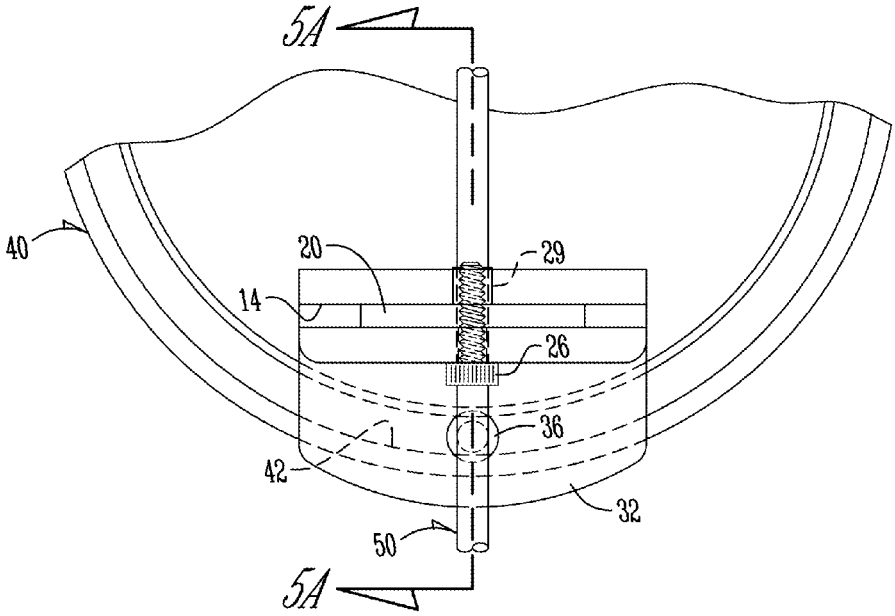
FIG. 5B is a partial top plan view of tool 10 mounted on can 40 with an arrow 50 in the process of being coated.

A conventional such can 40 has a side wall 46 and top with a formed sealing lip 44 that defines a groove 42 in which a circular flange of a container lid (not shown) can interference fit to seal the container 40. Mounting interface 30 of tool 10 takes advantage of groove 42 as follows. When the lid of can 40 is removed, top flange 32 of body 12 can be positioned over groove 42 (which is defined by annular side walls 47 and 48). Lower or bottom flange 34 of tool 10 extends a smaller distance laterally from main portion 13 than top flange 32 and acts as a support or mechanical stop against side wall 44 of can 40 (see FIG. 5A). Hole 38 through top flange 32 includes a threaded insert 39 (metal threaded insert, interference fit or otherwise fixed in place in hole 38). Thumb screw 36 has a threaded shaft that threadably mates with threaded insert 39 and can be turned down so that the distal threaded end of thumb screw 36 can extend through the space between top and bottom flanges 32 and 34 and into groove 42 to clamp the tool 10 in stable fashion on can 40. Note how the gap between upper and lower flanges 32 and 34 is sufficient so that the upper lip 44 of the can 40 is contained there between and the distal end of bottom flange 34 fits against the inner side of side wall 44 of can 40. Thumb screw 36 moves into abutment with the bottom of groove 42 to clamp body 12 to can 40. FIG. 5B illustrates clamped body 12 relative to can 40 from the top.

The sizes, spacing, and other configuration of flanges 32 and 34 are such that they cooperate to mount on many if not most can sizes of relevance (pint, quart, one-half gallon, gallon) which have a rim or lip. FIGS. 6A-D provide perspective illustrations of tool 10 clamped onto the upper lip 44 of a quart-sized can 40.

5. Assembly of Tool 10

Therefore, in this embodiment, after body 12 is prepared by forming slot 14 and emplacing inserts 29 and 39, final assembly involves inserting a removable wiper 20 in slot 14 and clamping it in place inside body 12 by one thumb screw 26. Tool 10 is then ready for use.

C. Operation

With further reference to FIGS. 6A-D, operation of an assembled tool 10 to coat an arrow shaft 50 will now be described. An appropriate wiper piece 20 is clamped into place in tool 10. For example, the size of opening 22 of disc 20 is selected to operably work with the shaft diameter of the arrow 50 to be coated. The liquid to be coated on arrow 50 is selected. The lid (not shown) of can 40 is removed.

1. Mount Tool 10 on Can 40

Tool 10 is clamped along the inside and top of can 40. (See installed position at FIG. 6A). Tool 10 can be quickly and easily clamped on to top lip 44 of can 40 by quick and easy turning of one thumb screw 36. Removal of tool 10 is similarly as easy by quick reversal of thumb screw 36 sufficiently to release the mounting interface 30 from can 40. In a similar fashion, wiper piece 20 can be removed, reinserted, or replaced with easy reversal of one thumb screw 26.

2. Apply a Quantity of Liquid on Arrow 50

Figure 6A:
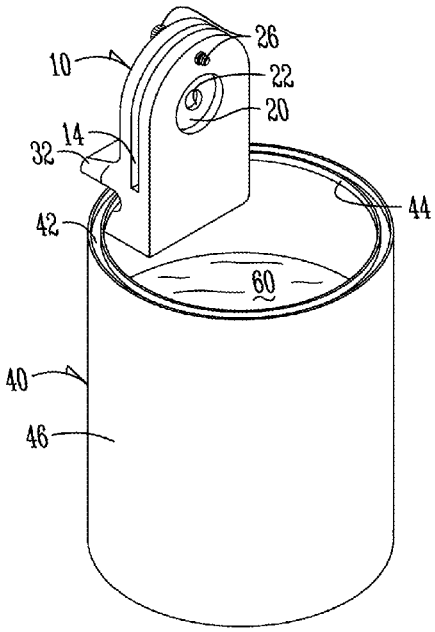
FIGS. 6A-D are perspective views illustrating use and operation of the embodiment of FIGS. 1-5 to coat a liquid on an arrow shaft when tool 10 is mounted on a can.
Figure 6B:
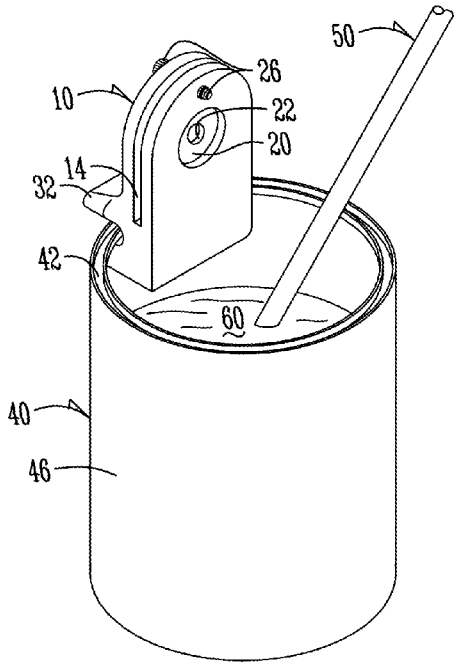

The point end 52 of arrow shaft 50 is dipped into the liquid 60 inside can 40 (FIG. 6B). By empirical methods, the amount of dipping (the amount of the point end dipped) to provide a sufficient quantity of liquid to coat the amount of the shaft desired to be coated, can be derived. But one feature of the present invention is that this does not have to be precise. Even if excess liquid is adhered to shaft 50 by that preliminary dipping, tool 10 tends to apply only enough needed for a relatively thin, even coating. Excess will not be allowed on the shaft by the wiping action of wiper 20. Alternatively, a quantity of liquid can be brushed, wiped, or otherwise moved from the can onto a portion of the arrow shaft over the can.

3. Align Dipped Arrow 50 with Wiper Opening 22

Once point end 52 is dipped, point end 52 is withdrawn from liquid 60 and can 40 and aligned essentially at or near axis 17 (or at opening 22 of wiper 20 on the inside side of tool 20 relative to can 40).

4. Move Dipped Arrow Through Wiper Opening 22

Point end 52 is then manually pushed through wiper opening 22 as steadily as possible (and along axis 12) for the desired coating distance of shaft 50.

Figure 6C:
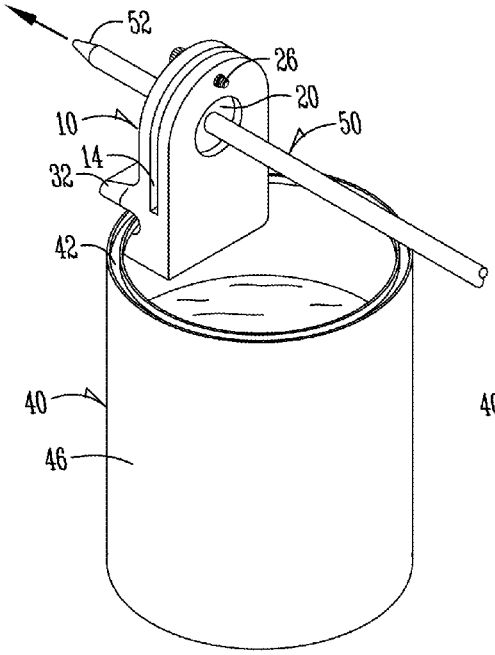
Figure 6D:
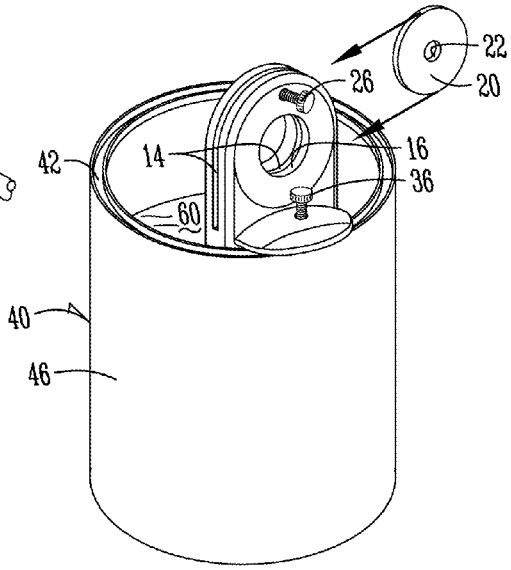

FIG. 6C shows shat pushed part of the way of the length of shaft 50 in the direction of the arrow.

To coat the entire shaft 50, the member continues to push/pull shaft 50 in the direction of the arrow in FIG. 6C until it completely moves past wiper 20 its entire length. Because the wiper blade effect of the edge of opening 22 abuts 360° around shaft 50, it wipes a thin coating of the liquid along shaft 50. Excess would build up around the perimeter of opening 22 on wiper 20 on its inside side. It would either stay on that side of wiper 20 or drip down along that side of tool 10. The shape of tool 10 can help direct at least some of the excess liquid down and back into the can by gravity. If the entire shaft 50 is to be coated, it is pushed all the way through opening 22 (ideally the whole shaft coating step is essentially a continuous, one-step movement).

If only a portion of the shaft is to be coated, end 52 could instead be inserted on the opposite or outside side of tool 10 and pushed inward towards the interior of can 40 for the desired distance over the mouth of the can. Liquid from the can be brushed, wiped, or otherwise moved from the can onto that portion of the shaft. The shaft can then be withdrawn (pulled) completely back out. Thus, tool 10 allows a "cap" to be produced on an arrow shaft by sliding shaft 50 that has a predetermined place on it (tape works nicely) from the outside in through wiper 20 a limited distance. Wiper 20 coats the liquid generously but consistently. Once the predetermined position is reached at wiper 20, shaft 50 is pulled back out in the opposite direction and the cap is formed. Again, any excess liquid caught at on the inner facing side of wiper 20 moves by gravity or can be helped back into the can.

Once one arrow shaft 50 is treated, another one, two, or more, can be likewise. Wiper 20 could be left in place if the same liquid coating is to be used, or it could be replaced each use or every several uses. Or it could be replaced for different fluids. An inventory of discs 20 with different sized openings 22 could be prepared and kept on hand (or otherwise be available) for different arrow shaft diameters. Alternatively, opening 22 of a desired size could be created (e.g. by punching, drilling, stamping, cutting, or otherwise) at or near the time the arrow or work piece is coated from an inventory of disks or wipers that does not have any opening 22. Wiper 20 could be made of a material that is economical to throw away after a limited number of uses.

Once use of tool 10 is completed, it is removed from can 40. It can be cleaned-up by removing and cleaning or throwing away wiper 20 and cleaning off body 12. The lid can be replaced on can 40. Tool 10 can be stored in clean condition for the next use.

As can be appreciated, use of tool 10 and the methodology described above can be applied in a system of coating arrow shafts that has a variety of benefits, some of which are subtle. It eliminates pouring liquid from one container to another. Clean-up is much quicker. Not only can liquid be coated onto the shaft quickly, easily, and uniformly, recapture of excess liquid not required to coat the arrow and quick and easy clean-up is provided. In this embodiment, wiper 20 is made of a material that is flexible. One way to clean up is to allow the excess liquid on it to harden. Wiper 20 is then simply flexed and the hardened liquid will pop or break off and can then be easily collected and disposed. And the material of body 12 usually allows easy clean up.

Tool 10 deters or eliminates liquid in groove 42 of can 40 as can occur when a brush or sponge is wiped on the lip. This deters liquid hardening in the groove which can hinder a complete reseal of the lid on the can after use.

D. Alternatives and Options

It would be appreciated by those skilled in the art that the invention can take many forms and embodiments. The exemplary embodiment described herein is but one form the invention can take. Variations obvious to those skilled in the art will be included within the invention which is defined solely by its claims.

For example, the materials of the components of tool 10 can vary. Body 12 can be made of a variety of different materials or composites. It does not have to be monolithic. It could be made of separate pieces that are combined or otherwise fastened together for the same or similar functions.

The method of mounting wiper 20 to body 12 can vary as can the ways in which wiper 20, if a separate piece, is removably mounted in body 12. It is possible that wiper 20 could be made integral with body 12 or be non-removable.

Furthermore, the mounting interface 30 could vary.

As mentioned, the material of wiper 20 can vary. As can the wiper edge 22. The precise size and shape of opening 22 can approximately match the outer perimeter shape of the item to be coated. It can be same size, slightly smaller size, or even slightly larger size so long as it can guide or apply a desired amount or thickness of consistent liquid coating along the work piece as the work piece is moved by and build up or capture excess amount. Generally, however, the opening will be the same size or slightly smaller than the outer perimeter dimension of the work piece. The wiper will have resiliency and flexibility such that with relatively small force the work piece can be inserted and pushed through opening 22 for a wiping action around the perimeter of the work piece as the application technique. However, if used to apply a coating, the wiper edge 22 would ideally not be so tight around the work piece that it would wipe or scrape all the liquid from the work piece, or otherwise prohibit a desired amount to be coated along the work piece.

As mentioned, different cross-sectional shapes of work pieces could be coated with tool 10. A triangular cross-section work piece, for example, could be coated with a wiper opening 22 of triangular shape. Other shapes, even asymmetrical, could be possible using analogous principles. Examples would be "D" shaped, elliptical, trapezoidal, to list just a few. In the exemplary embodiment, wiper 20 is essentially a flexible diaphragm with a center opening 22 that defines a 360° wiper blade or edge for circular-in-cross-section work pieces like arrow shafts. But the invention is not necessarily so limited.

What is claimed is:

1. A device to apply liquid coating from a container having a mouth defined by a lip for a resealable lid to a longitudinal surface of an elongated work piece, the work piece having a relatively uniform cross-sectional perimeter, comprising:

a body comprising a main portion for removably receiving a wiper piece and a mounting interface for removably mounting the body to the lip of the container;

the main portion having:

a length and width, a perimeter edge, and opposite sides extending generally on opposite sides of a first plane;

an opening between and through the opposite sides along an axis oblique to the first plane;

a slot between opposite sides of the main portion and having open and closed ends and a width, the open end extending from at least a part of the perimeter edge of the main portion, through a substantial part of the main portion of the body along the first plane, intersecting with the opening, and terminating in the closed end a distance past the opening but inside the main portion;

the mounting interface comprising a clamping portion comprising first and second flanges spaced apart and extending laterally from one of the opposite sides of the main portion along a second plane, and an adjustable clamping member on one said flange movable towards and away from the other flange to provide clamping action;

the interchangeable wiper piece removably insertably mountable into the slot of the main portion of the body, the wiper piece comprising a flexible and resilient sheet or layer having a length and width defining a perimeter, a thickness between opposite sides, an aperture between and through opposite sides a distance from the perimeter of the wiper piece, the aperture defining a wiping edge past which a work piece may be moved to wipe a liquid along that work piece, the aperture being smaller than the opening of the main portion and having a shape complementary to the cross-sectional perimeter of a work piece, wherein the thickness of the wiper piece is smaller than the width of the slot slidable insertion and removal.

2. The device of claim 1 wherein the sheet or layer of the wiper piece comprises a durometer of 40+/−5, a thickness of approximately 0.0625 inch, and an aperture in the range of approximately ¼ inch to 23/64 inch diameter, the slot is on the order of 1/16 inch wide.

3. The device of claim 1 wherein the wiping edge defines a continuous edge complementary to the entire perimeter of the work piece.

4. The device of claim 1 wherein the body comprises urethane.

5. The device of claim 1 wherein the elongated work piece is an arrow shaft having a diameter, the body is several inches by several inches by several inches in dimension, and the wiper piece is a sheet material with an opening of slightly smaller diameter than the diameter of the arrow shaft.

6. A system for coating elongated work piece having a cross-sectional shape and size with liquid comprising:

a. providing a container of liquid for coating the work piece;

b. removably mounting a coating tool on the container holding the liquid, the coating tool comprising:

i. a main body portion with a wiper piece receiver comprising a slot extending partially through and between opposite sides of the main body portion, the main body portion including a passageway between opposite sides that intersects with the slot;

ii. a mounting interface for adjustable mounting to a variety of containers wherein the mounting interface includes a clamp configured to releasably mount the main body portion to the container;

c. selecting a wiper piece comprising;

i. a flexible and resilient sheet or layer complementary to the slot in the main body portion;

ii. a through-hole having a shape and size complementary to the shape and size of the work piece;

d. removably inserting the wiper piece into the slot of the main body portion such that the through-hole of the wiper piece is within the passageway through the main body portion;

e. applying some of the liquid to a location on one end of the work piece while in or over the container;

f. inserting and moving that end of the work piece in a first direction into and past the through-hole of the wiper piece on the tool to begin coating the work piece with the liquid; and g. moving a substantial portion of a remainder of the work piece in the first direction past the through-hole of the wiper piece to spread the liquid and coat the substantial portion with the liquid.

7. The system of claim 6 wherein the work piece is an arrow shaft having opposite ends and a diameter.

8. The system of claim 7 wherein the wiper piece through-hole is circular and has a diameter on the order of diameter of the arrow shaft.

9. The system of claim 8 wherein the sheet or layer is rubber.

10. The system of claim 8 wherein the wiper piece through-hole has a diameter in the approximate range of ¼ inch to 23/64 inch.

11. The system of claim 6 wherein the wiper piece receiver receives interchangeable wiper pieces with different size and shape through-holes for different size and shape work pieces.

* * * * *